US005546683A

United States Patent [19]

Clark

[11] Patent Number: 5,546,683

[45] Date of Patent: Aug. 20, 1996

[54] BUCKET ATTACHMENT DEVICE WITH REMOTE CONTROLLED RETRACTABLE PINS

[76] Inventor: George J. Clark, 7100 Trumble La., St. Clair Shores, Mich. 48079

[21] Appl. No.: 129,459

[22] Filed: Sep. 29, 1993

[51] Int. Cl.[6] ..... F02F 3/81; F02F 3/70

[52] U.S. Cl. ..... 37/468; 172/272; 414/723

[58] Field of Search ..... 37/468, 235; 172/272, 172/275; 414/723, 724; 403/150, 151, 152, 153, 325, 5, 31, 321, 322, 323, 324, 166

[56] References Cited

U.S. PATENT DOCUMENTS

| | | | |
|---|---|---|---|
| 4,030,624 | 6/1977 | Matthews | 214/145 A |
| 4,096,957 | 6/1978 | Iverson et al. | 214/145 R |
| 4,136,792 | 1/1979 | Wilson | 214/145 A |
| 4,187,050 | 2/1980 | Barbee | 414/723 |
| 4,214,840 | 7/1980 | Beales | 403/31 |
| 4,251,182 | 2/1981 | Schroeder | 414/723 |
| 4,295,287 | 10/1981 | Natzke et al. | 37/103 |
| 4,297,074 | 10/1981 | Ballinger | 414/723 |
| 4,355,945 | 10/1982 | Pilch | 414/686 |
| 4,373,852 | 2/1983 | Maurer | 414/723 |
| 4,480,955 | 11/1984 | Andrews et al. | 414/723 |
| 4,632,595 | 12/1986 | Schaeff | 403/330 |
| 4,643,631 | 2/1987 | Maurer et al. | 414/723 |
| 4,661,036 | 4/1987 | Horsch | 414/686 |
| 4,710,091 | 12/1987 | Ochiai et al. | 414/623 |
| 4,726,731 | 2/1988 | Jones | 414/723 |
| 4,836,741 | 6/1989 | St. Louis et al. | 414/723 |
| 4,984,957 | 1/1991 | Noguchi et al. | 414/723 |
| 5,010,962 | 4/1991 | Bloom, Jr. | 172/430 |
| 5,049,027 | 9/1991 | Morrison et al. | 414/723 |
| 5,324,162 | 6/1994 | Kishi | 37/468 X |

FOREIGN PATENT DOCUMENTS

| | | | |
|---|---|---|---|
| 618501 | 8/1978 | U.S.S.R. | 37/468 |
| 2169582 | 7/1986 | United Kingdom | 37/468 |
| 2239445 | 7/1991 | United Kingdom | 37/468 |

*Primary Examiner*—Eric K. Nicholson
*Assistant Examiner*—Robert Pezzuto
*Attorney, Agent, or Firm*—Remy J. VanOphem; John VanOphem

[57] ABSTRACT

A quick coupling for attaching and detaching an implement, such as a bucket, pick or compactor, to the end of a boom or dipperstick of an excavator, backhoe, or other earth moving machine. The quick coupling is compatible with industry standard type hook-ups used on a bucket. The quick coupling is primarily a hook member, for receiving a front pivot pin on the top of the bucket or other implement, and a pivot pin assembly having axially movable end portions which move between a first position in which the end portions are contained within the main body of the coupling and the implement is detached, and a second position in which the end portions project from the main body and engage respective holes located on the implement and adapted to receive the pivot pin end portions thereby coupling the bucket or other implement to the end of the boom.

7 Claims, 3 Drawing Sheets

BUCKET ATTACHMENT DEVICE WITH REMOTE CONTROLLED RETRACTABLE PINS

BACKGROUND OF THE INVENTION

1. Field of the Invention

The present invention generally relates to a coupling for attachments to earth-moving or excavating machines, such as an excavator or backhoe. More particularly, the present invention relates to a low pressure, hydraulically operated, quick-coupling used to connect and disconnect a bucket or other operating tool to the boom or dipperstick of an excavator or backhoe and which is completely operable from within the cab or operator's chair of the machine.

2. Description of the Prior Art

Traditionally, the bucket of an excavator, backhoe or similar earth moving machine is attached to the boom or dipperstick arm through the use of pins inserted through brackets on the bucket and a hole through the end of the boom. Typically, the changing from one implement to another is a two person job. The operator would move the boom or dipperstick so that the end of the boom was positioned next to the bucket such that the pivot pins could be inserted by a second person through the holes in the brackets on the top of the bucket and in the end of the boom. A person on the ground would hand signal the operator up, down, back or forward in order to align the holes of the bucket and the boom. The pins are then inserted and secured. An entire operation, releasing a tool and attaching a new tool, took a great deal of time and effort since the tools being changed are typically very heavy and very cumbersome. Thus, it became apparent that a quick-coupling was required which would shorten the time needed to accomplish the above described operation and make it possible for only the operator without assistance by another person to accomplish the changing from within the cab of the backhoe or excavator.

The prior art discloses many types of quick-couplings for attaching a bucket or other tool to the boom or loader scoop arm of a backhoe, loader or other similar earth moving machine. For example, the following patents disclose and teach couplings which are improvements over the traditional method but still require some type of physical intervention to effect the changing of the tool: U.S. Pat. Nos. 4,030,624, to Matthews; 4,187,050, to Barbee; 4,295,287, to Natzke et al.; 4,373,852, to Maurer; 4,632,595, to Schaeff; and 4,643,631, to Maurer et al.

In addition to the above, U.S. Pat. No. 4,836,741, to St. Louis et al. discloses a quick coupling for detachably connecting a bucket to a boom, an excavator or a backhoe. St. Louis et al. disclose a main body adapted to be connected to a boom or dipperstick of an excavator or backhoe. A bucket or other implement has a pair of industry-standard, spaced apart, contoured, support brackets welded thereto for connection to the boom or dipperstick. A first pair of aligned and opposite apertures in each of the support brackets contain a first upper bucket pin. A second pair of aligned and opposite apertures in each of the support brackets are spaced a predetermined distance from the first pair containing the first upper bucket pin. St. Louis et al. disclose that the main body has a transverse hook formed therein for receiving the first upper bucket pin and a bore spaced a predetermined distance from the transverse hook such that in the connected position the bore aligns with the second pair of aligned and opposite apertures in the support brackets of the bucket. St. Louis et al. teach that an eccentric bushing is displaced within the bore and then rotated to align the bore with the second pair of apertures on the bucket so that a pin can then be manually inserted and secured in place.

U.S. Pat. No. 4,480,955, to Andrews et al. discloses a quick release and attachment coupling for use with an earth moving or excavating machine. Andrews et al. disclose that a V-shaped slot is provided on one side of the head of the boom in which a transverse bar or beam of the tool is located, then a movable block in the head of the boom is moved by a hydraulic ram into engagement with a hook or jaw on the tool to lock the head of the boom to the operating tool. A drawback of the Andrews et al. device is that it requires the operating tool to be specially equipped in order to be used with the Andrews et al. quick release and attachment coupling. As a result the Andrews et al. coupling cannot be used with what is considered to be the industry standard coupling for an attachment to an excavator. Similar to Andrews is U.S. Pat. No. 4,297,074, to Ballinger, which also discloses a coupling for an implement, and like the Andrews device, is not compatible with an industry standard implement having a pair of spaced apart pivot pins for attachment to the excavator or backhoe.

The Hendrix-J. B. Quick Coupler disclosed in the publication entitled *THE MOST VERSATILE HYDRAULIC COUPLER IN THE WORLD*, discloses a quick coupler for use with an excavator which allows an operator to quickly change from one implement to another. The quick coupler disclosed is essentially a pair of hooks disposed so as to cooperate with a pair of pins located on the implement to be attached. The first hook is fixed and the second hook of the quick coupling is hydraulically operable between an open and a closed position. Springs are provided to bias the second hook in the closed position and a hydraulic piston is operable to open the second hook in order to release or grasp the pin of the implement. However, the Hendrix Coupler is expensive because it requires a specially manufactured housing to contain the second hydraulically operable hook and springs. Additionally, the Hendrix coupler is not completely safe because if the weight of the implement and load exceed the bias force of the springs, the implement could break free from the quick coupler.

As the above-mentioned patents disclose, it is well known to provide a device which will allow for quick changing of the bucket or other working tool connected to an earth-working machine, such as an excavator or backhoe. It is also well known that it is advantageous to provide a device which will accomplish this task remotely from the operator's position because changing from one bucket or tool to another is time consuming and labor intensive and therefore costly. Thus, what is needed is to provide an apparatus which makes it possible for the operator, without any help or any need to leave the controls of the machine, to quickly and easily exchange the bucket or other working tool connected to the boom of the machine for another tool. However, none of the prior art references disclose a quick disconnect coupling device which is cost effective, requires a minimal amount of time to install and is completely failsafe.

SUMMARY OF THE INVENTION

The present invention relates to an improved apparatus and method for changing an implement, such as a bucket, pick or compactor, connected to the boom or dipperstick of an excavator or backhoe. In particular, the present invention relates to a quick coupling for use in detachably connecting an implement to an excavator or backhoe which is completely operable from the operator's seat; requires a minimal amount of time to install, operate and maintain; and avoids the attendant problems and difficulties associated with similar prior art devices. The present invention accomplishes this operation without requiring specially designed equipment and, more importantly, without requiring the operator or other personnel to remove or insert the pivot pins used to attach the implement to the boom of the excavator.

This invention completely eliminates the need to have someone in addition to the machine operator for changing the bucket and it also eliminates any need for the machine operator to leave the operating controls of the excavator, backhoe, or other earth moving machine. Additionally, the present invention provides for a system which accomplishes the above but can either be easily and inexpensively adapted to a current industry accepted standard coupling, without any need for alterations or additional parts, or can be easily installed as part of the original equipment manufacturing process. Further, the above is accomplished with a system having a safety feature which makes the coupling completely safe for use in any work site and completely eliminates any possibility of the bucket falling off if there is a loss of hydraulic power.

According to the present invention, the foregoing is achieved by utilizing a remotely controlled, positively locked, hydraulically retractable pivot pin assembly disposed in a bore of a coupling having a transverse hook member spaced a predetermined distance from the pivot pin assembly. The upper end of the quick coupling of the present invention is attached to the end of the boom of the excavator. The lower end of the quick coupling is a transverse hook segment configured into the main body of the coupling for receiving a pivot pin located on the top of the implement to be coupled to the boom of the excavator. Spaced a predetermined distance from the transverse hook is a pair of pivot pin portions disposed in a transverse bore located in the lower portion of the coupling. A resilient member is located between the pivot pin portions to bias the pivot pin portions outward in a direction extending from the coupling. Hydraulic controls are provided for overcoming the biasing device and contracting the pivot pin portions within the coupling. The implement has a pair of spaced apart flange members which cooperate with the main body of the coupling by the use of a pair of transversely orientated bores adapted to receive the pivot pin portions of the coupling.

An object of the present invention is to provide a quick coupling for facilitating the interchange of implements to the end of a boom or dipperstick of an excavator or backhoe entirely from the operator's position within the cab of the vehicle without any need for a person to assist in connecting the pivot pins or other means for attaching the implement to the end of the boom.

It is a further object of the present invention to effect the foregoing objects with a quick coupling which will safely and quickly facilitate the interchange of implements to the end of a boom of an excavator or the like and which eliminates the attendant safety problems of the prior art devices.

It is a further object of the present invention to effect the foregoing objects with a quick coupling which is capable of being installed during the original production process of the excavator or which can be easily retrofitted to a standard excavator in the field.

It is still a further object of the present invention to effect the foregoing objects with a quick coupling which is capable of being operated on relatively low-pressure hydraulics as compared to the main high-pressure hydraulics used to operate the excavator or backhoe.

It is a further object of the present invention to effect the foregoing objects with a quick coupling which is significantly simplified compared to the prior art devices.

It is a further object of the present invention to effect the foregoing objects with a quick coupling which is safer yet significantly less expensive than the prior art devices due to its simplicity and its ability to be extremely safe while operating within a relatively low-pressure hydraulic system.

Other objects and advantages of the present invention will become apparent from the following detailed description of the invention which follows, with reference being made to the accompanying drawings.

DETAILED DESCRIPTION OF THE PREFERRED EMBODIMENT

Figure 3:
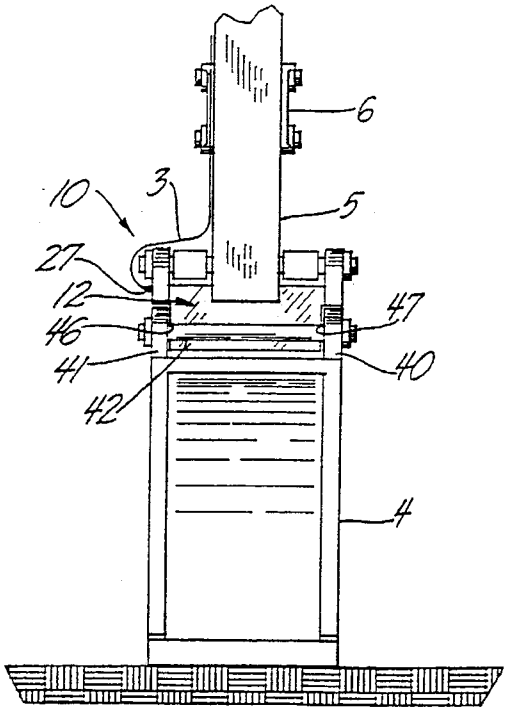
FIG. 3 is an elevational view of the coupling shown in FIG. 2.
Figure 2:
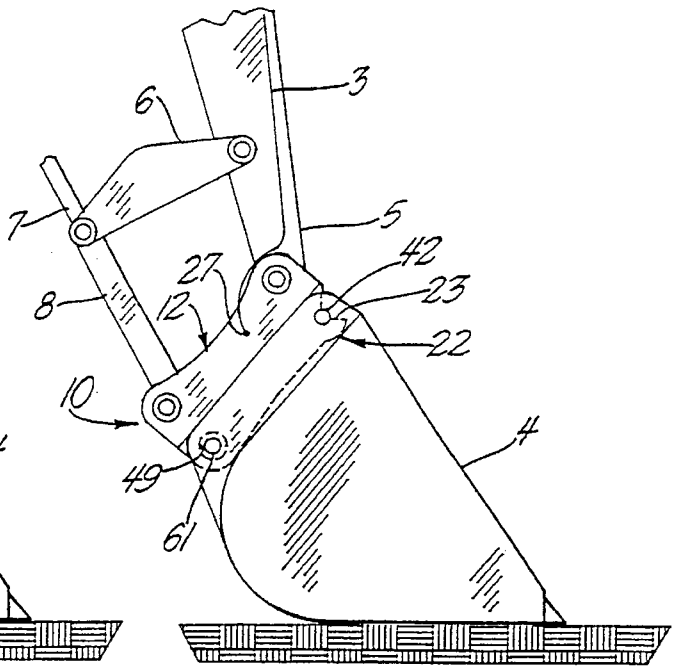
FIG. 2 is a side view of the invention, illustrating the coupling completely connected to the bucket.
Figure 1:
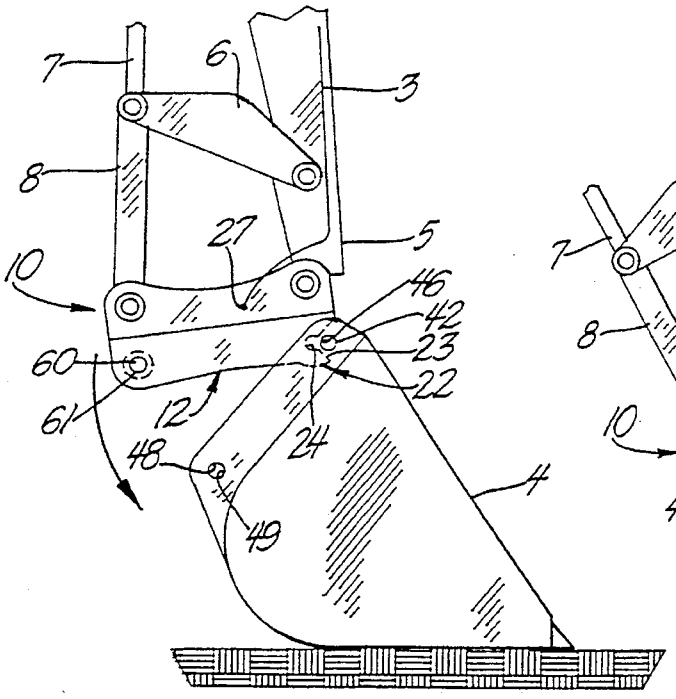
FIG. 1 is a side view of one embodiment of the invention, illustrating the manner in which the coupling is interconnected between the end of the boom and the bucket.
Figures 4, 5:
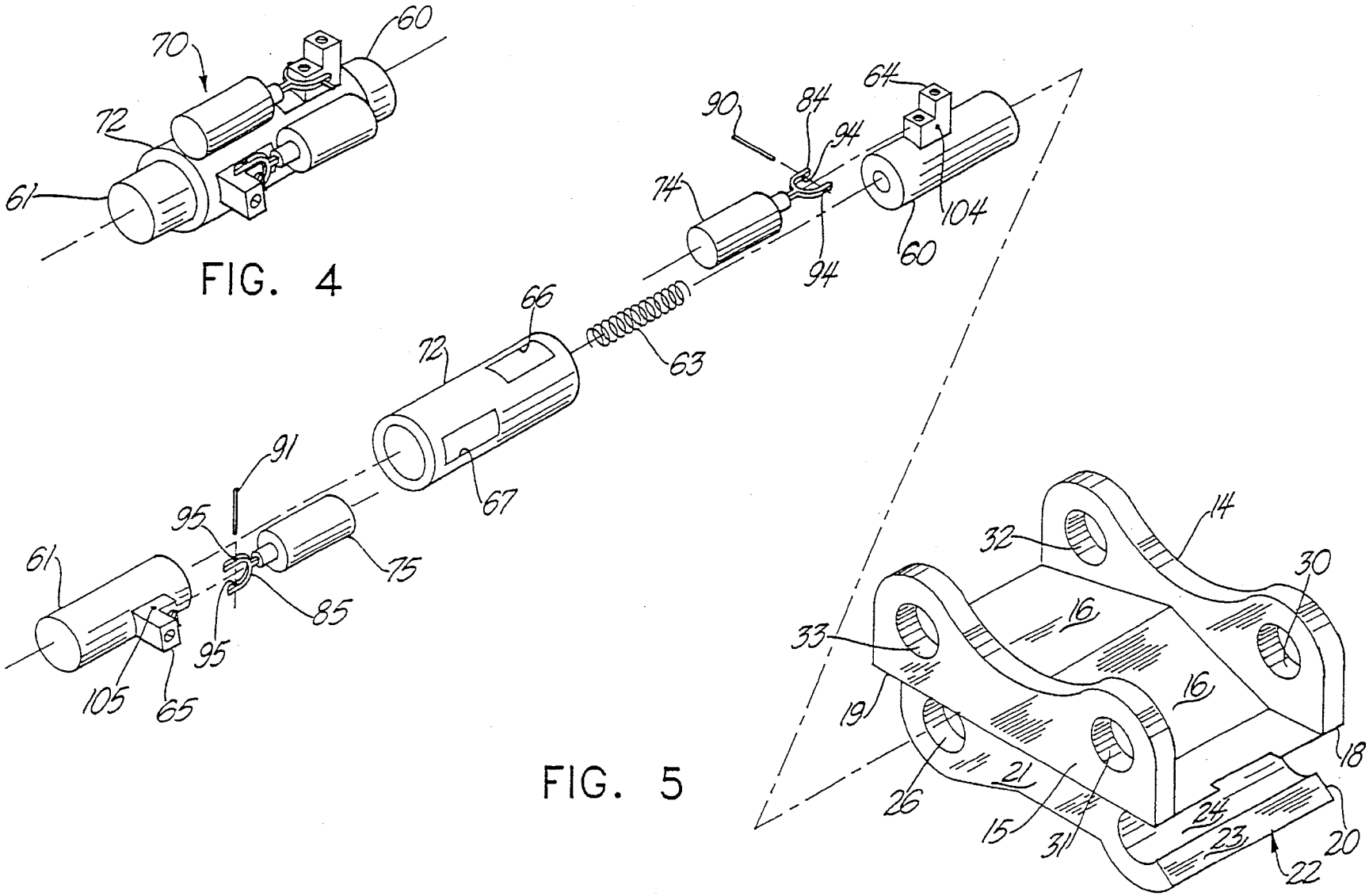
FIG. 4 is a perspective view of the pivot pin assembly of the quick-coupling of the present invention.
FIG. 5 is a detailed exploded perspective view of the pivot pin assembly of the quick-coupling of the present invention.

Referring to the drawings, FIGS. 1 through 3 illustrate a quick coupling 10 according to the present invention connected to an end 5 of a boom 2 of an excavator 1 and connecting thereto an implement in the form of a bucket 4. The quick coupling of the present invention, generally designated 10, includes a main body 12 adapted to be connected to the boom end 5 of the excavator shown in FIG. 6. The main body 12 of the quick coupling 10, see FIG. 5, is a member having a pair of upstanding spaced apart flange portions 14 and 15 on the top portion thereof. At one end of the spaced apart flange portions 14 and 15, each of the flanges 14 and 15 have a pair of transversely aligned opposite holes 30 and 31. The holes 30 and 31 are located in each respective flange portion 14 and 15 and are aligned to receive a pivot or hinge pin. Similarly, holes 32 and 33 are located near the opposite end of the flange portions 14 and 15, respectively, and are also in line with one another in order to receive a pivot or hinge pin. Additionally, the holes 32 and 33 are spaced a predetermined distance from the holes 30 and 31. The predetermined distance is chosen such that the holes will match up to the end of the boom and the end of a second link 8, both of the excavator shown in FIG. 6.

Figure 6:
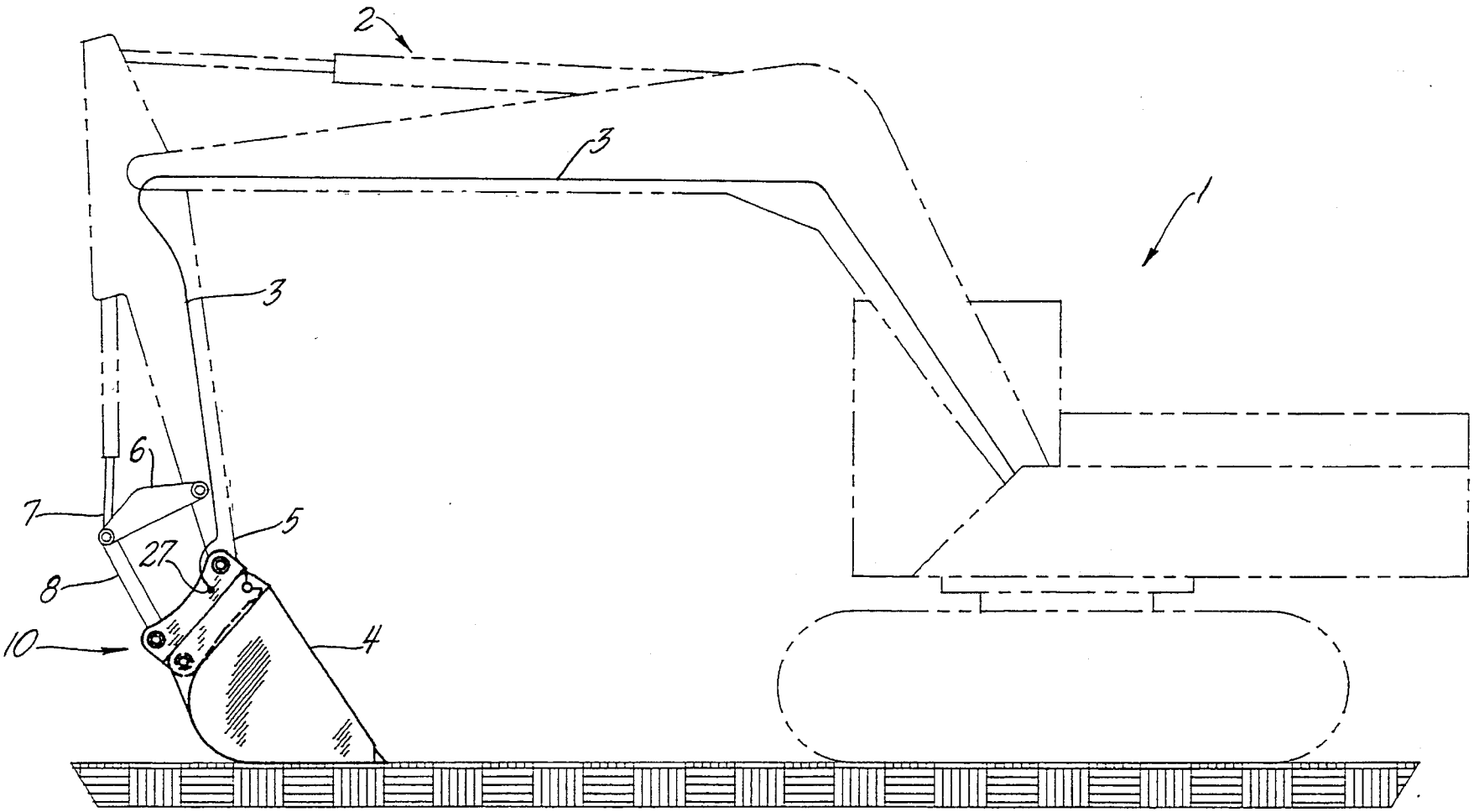
FIG. 6 is a side view of an excavator having a bucket attached using the quick-coupling of the present invention and its accompanying hydraulic lines.

As illustrated in FIGS. 1 through 3, the end 5 of the boom has a first link 6 connected to the end 5 of the boom and at the other end connects to a push rod 7 of a hydraulic cylinder shown in FIG. 6. The second link 8 interconnects the end of the push rod 7 and the first link 6 to the flange portions 14 and 15 at the holes 32 and 33. The holes 32 and 33 are aligned with a hole (not shown) in the end of the second link 8 and a pivot pin is inserted therethrough and then secured in place. The same is done for a hole in the boom end 5 and the holes 30 and 31 of the flange portion 14 and 15, respectively.

Referring again to the main body 12, between the spaced apart flange portions 14 and 15 is a top surface 16 from which the spaced apart flange portions 14 and 15 project upwardly. Below the top surface 16, the main body 12 has a narrower width, thereby resulting in a first undersurface 18 and a second undersurface 19 at the sides of the top surface 16 and below the flange portions 14 and 15. In the narrowed region of the main body 12 are a pair of spaced apart side walls 20 and 21 which are aligned substantially parallel to the spaced apart flange portions 14 and 15. The side walls 20 and 21, at one end of the main body 12, have a hook member 22 integral therewith. The hook member 22 is preferably a recess cut into the front end of the main body 12. The hook member 22 has a leading front angled surface 23 which is angled toward the recess of the hook member 22 in order to facilitate alignment of the pivot or hinge pin adapted to receive the hook member 22. The side walls 20 and 21, at the opposite end of the main body, have a through bore 26 for cooperating with the quick coupling 10 as described hereinafter.

In the preferred embodiment shown in FIGS. 1 through 3, the bucket 4 is of a standard type and has a pair of upstanding spaced apart contour fitting support lugs 40 and 41. The support lugs 40 and 41 are spaced a predetermined distance from one another in order to receive the lower narrowed portion of the main body 12 therebetween. Each of the lugs 40 and 41 have a first and second pair of transversely aligned opposite holes 46 and 47 and 48 and 49, respectively, therein. The first pair of holes 46 and 47 are located near the top and front of the bucket 4. The second pair of holes 48 and 49 are located in the end of the lugs 40 and 41, respectively, near the rear of the bucket 4. The first pair of holes 46 and 47 are adapted to receive a transversely extending upper bucket pin 42. The second pair of transversely aligned opposite holes 48 and 49 are adapted to receive partial pivot pin portions 60 and 61 of a pivot pin assembly, generally designated 70, as best illustrated in FIGS. 4 and 5.

The pivot pin assembly 70 includes the pair of pivot pins or pivot pin portions 60 and 61 which are adapted to fit in the holes 48 and 49 of the bucket 4. The pivot pin portions 60 and 61 are essentially cylindrical in shape in the preferred embodiment, however, it will be readily apparent to one skilled in the art that the pivot pins may be any convenient shape. The pivot pin portions 60 and 61 are contained within the bore 26 of the main body 12 of the quick coupling 10. The pivot pin portions 60 and 61 are also disposed in a cylinder 72 which is placed in the main body 12 in alignment with the bore 26. The pivot pin portions 60 and 61 are located at opposite ends of the bore 26.

A spring 63 is located in the cylinder 72 between the pivot pin portions 60 and 61 such that the spring 63, or any other suitable biasing means, biases the pivot pin portions 60 and 61 to move outward from the main body 12. The pivot pin portions 60 and 61 are axially secured and guided within the cylinder 72 by block portions 64 and 65, respectively. The block portions 64 and 65 are attached to the pivot pin portions 60 and 61 after the pivot pin portions 60 and 61 are inserted in the cylinder 72 with the spring 63 located therebetween. By way of example, the pivot pin portion 61 is placed in the cylinder 72 and then the block portion 65 is inserted through a channel slot 67 and secured to the pivot pin portion 61. Similarly, after the spring 63 is inserted into the cylinder 72, the pivot pin portion 60 is inserted in the cylinder 72 and then the block portion 64 is inserted through a channel slot 66 in the cylinder 72 and then secured to the pivot pin portion 60.

The pivot pin portions 60 and 61 are biased outward by the spring 63 to the point where the block portions 64 and 65 abut the end of the slots 66 and 67, respectively, of the cylinder 72. To overcome the spring 63 and to retract the pivot pin portions 60 and 61, a pair of hydraulic cylinders 74 and 75 are provided. The hydraulic cylinders 74 and 75 each have their piston rod ends connected to the block portions 64 and 65, respectively. As shown in FIG. 5, the hydraulic cylinders 74 and 75 are connected to the cylinder 72 and aligned parallel therewith and offset from each other approximately ninety degrees. The offset is determined by the offset between the channel slots 66 and 67. It is contemplated that the channel slots 66 and 67 may be offset in any convenient manner to permit a more compact design.

The hydraulic cylinders 74 and 75 each have a hydraulic line (not pictured) connected thereto in order to provide pressure to retract their respective pivot pin portions. The hydraulic lines are supplied by an hydraulic line 3 as shown in FIG. 6, which runs from a point near the controls of the excavator 1 up along the boom 2 to the end 5 of the boom and then enters the main body 12 and a swivel joint 27. The hydraulic line 3 is connected to a pump (not shown) and a hydraulic fluid reservoir (not shown). The pump is controlled from the operator's position within the excavator 1 via a switch (not shown) which activates a standard servo (not shown). It should be noted that it is preferable to make the operator's switch a double-acting or constant pressure switch in order to prevent accidental operation of the pivot pin assembly 70. The hydraulics which operate the quick coupling are of the low pressure type as compared to the standard high pressure hydraulics of an excavator.

While it would be possible to patch the hydraulics of the quick coupling into the hydraulics of the excavator, this would unnecessarily increase the cost of the quick coupling and would also make it much more difficult to retrofit the quick coupling to excavators already in service. In an alternative embodiment it is possible to provide for a second hydraulic line to connect to the opposite side of the cylinders 74 and 75 such as to provide a double-acting cylinder in order to provide positive pressure to move the pivot pin portions 60 and 61 into the extended position in biasing the pins in an outward direction. Naturally, in such case this additional biasing may result in the use of a smaller spring and smaller hydraulics since the force to retract the pins and overcome the spring force may be significantly reduced. However, in such case, if the hydraulics fail, the spring force would still bias the pins 60 and 61 to remain in the holes 48 and 49 of the bucket but would do so at a lower retention force and assist the spring 63.

The hydraulic cylinders 74 and 75 have rod ends 84 and 85 connected to the block portions 64 and 65, respectively. The rod ends 84 and 85 are essentially U-clips which fit on the sides of the block portions 64 and 65. The ends of the U-clips have a pair of aligned holes 94 and 95, respectively, in the ends of the legs thereof. The aligned holes 94 and 95 are designed to align with holes 104 and 105 provided in the block portions 64 and 65, respectively. Once the holes 94 and 95 of the U-clips 84 and 85 are aligned with the holes 104 and 105 of the block portions 64 and 65, pins 90 and 91 are inserted through the holes to secure the U-clips 84 and 85 to the block portions 64 and 65, respectively. Finally, the pivot pin assembly 70 is fixedly installed in the main body 12 such that the pivot pin portion 61 is located in the bore 26 near the side wall 21 and the pivot pin portion 60 is located in the bore 26 near the side wall 20.

In operation of the preferred embodiment, when the hydraulic cylinders 74 and 75 are actuated by the operator sitting in the cab portion of the vehicle, the pivot pin portions 60 and 61 are retracted from the holes 48 and 49 to a position wherein they are completely contained within the bore 26. When the hydraulic cylinders 74 and 75 are deactuated, the biasing spring 63 forces the pivot pin portions 60 and 61 into an extended position in which the pivot pin portions 60 and 61 extend from the bore 26 on opposite sides of the main body 12 into the holes 48 and 49 of the lugs 40 and 41 of the bucket. Since the spring 63 must also overcome the back pressure in the hydraulic lines of the system, the pivot pin portions 60 and 61 will move slowly outward to their extended position.

It is possible to choose a spring which will cause the pivot pin portions 60 and 61 to move outward more or less quickly. Additionally, the spring 63 is also preferably chosen such that the hydraulic force required to move the pivot pin portions 60 and 61 to the retracted position is substantial to prevent the pivot pins from being easily displaced, thereby ensuring a high degree of safety.

Once the pivot pin assembly 70 is installed in the main body 12 and the quick coupling 10 is connected to the end 5 of the boom, the quick coupling is ready to be used. With a bucket 4 or other implement laying on the ground, the boom 2 of the excavator 1, see FIG. 6, is moved by the use of the controls which are within reach of the operator's seated position. As previously discussed, the bucket 4 has an upper pin 42 which is adapted to be received by the hook member 22. The bucket 4 also includes the pair of holes 48 and 49 in its upstanding spaced apart support lugs 40 and 41 which are adapted to receive the pivot pin portions 60 and 61 of the pivot pin assembly 70.

The operator of the excavator 1 will first move the boom 2 of the excavator 1 to a position in which the opening of the hook member 22 is aligned with the upper pivot pin 42 of the bucket 4 and engage the hook member 22 to the upper pin 42. At this point, the bucket is substantially in the position as shown in FIG. 1. The end 5 of the boom 2 is then manipulated to move the push rod 7 and thereby advance the main body 12 towards the bucket until the upper pivot pin 42 of the bucket 4 is caught by the leading front surface 23 and directed into the hook member 22 until it is in contact with a partial cylindrical surface 24 of the hook member which is adapted to receive the pivot pin 42. If the pivot pin portions 60 and 61 are not in the retracted position, then the operator must at this point actuate the hydraulic cylinders 74 and 75 to pull the pivot pin portions 60 and 61 within the side walls 20 and 21 of the main body 12.

The main body is then rotated from the position shown in FIG. 1 to the position shown in FIG. 2 to align the pivot pin portions 60 and 61 with the holes 48 and 49 of the lugs 40 and 41. The pivot pin portions 60 and 61 are then extended by the hydraulic cylinders 74 and 75 to move into the holes of the support lugs 40 and 41.

This is accomplished once the upper pivot pin 42 of the bucket 4 is seated within the partial cylindrical surface 24 of the hook member 22, by extending the push rod 7 to cause the quick coupling 10 to rotate about the holes 30 and 31 in the spaced apart flange portions 14 and 15, thereby bringing the pivot pin portions 60 and 61 to a position between the support lugs 40 and 41 of the bucket 4 and approximately aligned with the holes 48 and 49 of the support lugs 40 and 41. At this point, the hydraulic cylinders 74 and 75 are deactuated, that is, the hydraulic motor supplying pressure is turned off, whereby the biasing force of the spring 63 causes the pivot pin portions 60 and 61 to begin to move towards the extended position and the back pressure of the hydraulic line 3 is overcome.

If the pivot pin portions 60 and 61 are perfectly aligned with the holes 48 and 49 of the support lugs 40 and 41, then they will move completely into the fully extended position, that is, to the point where the block portions 64 and 65 move to the end of the channel slots 66 and 67. If the pivot pin portions 60 and 61 are not perfectly aligned with the holes 48 and 49 of the support lugs 40 and 41, then the operator simply moves the push rod 7 back and forth until the pivot pin portions 60 and 61 are appropriately aligned with the holes 48 and 49. The spring 63 is chosen in such a way as to ensure that the pivot pin portions 60 and 61 will spring outward and quickly overcome any back pressure in the hydraulic line 3. Therefore, both of the above mentioned methods of extending the pivot pin portions 60 and 61 will result in them being inserted in the holes 48 and 49 of the support lugs 40 and 41, respectively.

At this point the bucket 4 or other implement is fixedly secured to the end 5 of the boom 2 through the use of the quick coupling 10. It should be noted that this is accomplished entirely from the operator's seated position within the cab of the vehicle by utilizing the controls of the excavator 1 without any need for assistance and without any need for the operator to leave the controls of the excavator 1. Additionally, the bucket is attached to the boom 2 in such a manner that it is virtually impossible for the bucket to become detached. Even a loss in hydraulic power will not result in the bucket 4 becoming detached from the boom 2, since the biasing force of the spring member keeps the pivot pin portions extended regardless of pressure loss in the hydraulic system.

To detach the bucket 4 or other implement from the boom 2 of the excavator 1, all that need be done is for the operator to first move the bucket 4 to a safe location and then actuate the switch (not shown) to turn on the hydraulic motor (not shown) to supply hydraulic pressure to the hydraulic cylinders 74 and 75 of the pivot pin assembly 70. This causes the pivot pin portions 60 and 61 to retract from the holes 48 and 49 of the support lugs 40 and 41 of the bucket 4 enabling the pivoting of the main body about the upper pivot pin 42. The operator then moves the end 5 of the boom 2 so as to pivot the main body 12 about the upper pivot pin 42 of the bucket 4 and retract the hook member 22 such that the hook member 22 is no longer contained about the upper pivot pin 42 of the bucket.

The above described operation of the present invention can easily be repeated for implements other than the bucket 4. It is also possible to operate the quick coupling of the present invention in such a way that the bucket 4 or other implement need not necessarily be located in an optimal position in order for the quick coupling 10 of the present invention to work.

While the invention has been described in terms of a preferred embodiment, it is apparent that other forms could be adopted by one skilled in the art. Accordingly, the scope of the invention is to be limited only by the following claims.

What is claimed is:

1. A quick coupling device for attaching and releasing an implement to a boom of an earth moving vehicle, such as an excavator, said quick coupling device comprising:

a main body having a first end and a second end, said first end having a hook member integrally formed therein for engaging said implement, said second end of said main body having a bore therethrough;

means for connecting said main body to said boom wherein said quick coupling device is mounted to an end of said boom of said earth moving vehicle;

a first pivot pin located in said bore in said main body;

a second pivot pin separate from said first pivot pin located in said bore in said main body and axially aligned with respect to said first pivot pin;

means for biasing mounted in said bore of said main body between said first and second pivot pins such that said biasing means biases said first and second pivot pins in directions away from each other so that an end portion of each of said first and second pivot pins projects from said bore in said main body; and means for selectively moving said first and second pivot pins in a direction toward each other, such that said first and second pivot pins are contained within said bore of said main body, said moving means being capable of overcoming said biasing means, said means for selectively moving said first and second pivot pins comprising:

a first hydraulic cylinder attached to and aligned with said first pivot pin for moving said first pivot pin to a position in which said first pivot pin is contained within said main body; and a second hydraulic cylinder attached to and aligned with said second pivot pin for moving said second pivot pin to a position in which said second pivot pin is contained within said main body;

whereby after said main body is connected to said boom, and said boom is manipulated to engage said hook member with said implement at a predetermined point on said implement, and said first and second pivot pins are contained within said main body by said moving means, said bore in said main body is then aligned with a bore in said implement such that when said moving means is disengaged, said biasing means cause said first and second pivot pins to engage said bore in said implement, thereby connecting said implement to said main body and said boom.

2. The quick coupling device of claim 1 wherein said means for biasing said first and second pivot pins is a spring axially aligned in said bore between said first and second pivot pins.

3. The quick coupling device of claim 1 wherein said end of said boom has a transverse bore therethrough and said means for connecting said main body to said boom comprises:

a first plate connected to said main body and having a hole therein;

a second plate connected to said main body and having a hole therein aligned with said hole of said first plate, said second plate being spaced a predetermined distance from said first plate; and a pin passing through said hole in said first plate, said transverse bore in said end of said boom and said hole in said second plate.

4. The quick coupling device of claim 3 wherein said means for biasing said first and second pivot pins is a spring located in said bore in said main body and axially aligned between said first and second pivot pins.

5. The quick coupling device of claim 1 wherein said implement has a transverse lifting bar connected thereto and said hook member of said main body is adapted to receive said transverse lifting bar of said implement.

6. The quick coupling device of claim 1 wherein said means for moving said first and second pivot pins comprises means for remotely operating said moving means from an operator's position within said earth moving vehicle.

7. A quick coupling device for attaching and releasing an implement to a boom of an earth moving vehicle, said quick coupling device comprising:

a main body having at least one bore therethrough;

means for connecting said main body to said boom;

a first pivot pin located in said at least one bore in said main body;

a second pivot pin separate from said first pivot pin located in said at least one bore in said main body and axially aligned with respect to said first pivot pin;

means for biasing mounted in said at least one bore of said main body between said first and second pivot pins such that said biasing means biases said first and second pivot pins in a direction away from each other so that an end portion of each of said first and second pivot pins projects from said main body; and means for selectively moving said first and second pivot pins in a direction toward each other, such that said first and second pivot pins are contained within said at least one bore in said main body, said moving means being capable of overcoming said means for biasing; whereby after said main body is connected to said boom and said first and second pivot pins are contained within said main body by said moving means, said main body is then aligned with said implement such that when said moving means are disengaged, said biasing means cause said first and second pivot pins to engage said implement, thereby connecting said implement to said main body and said boom.

* * * * *